United States Patent [19]

Birkin

[11] Patent Number: 4,538,781

[45] Date of Patent: Sep. 3, 1985

[54] CONTROL SYSTEM FOR CONTROLLING THE PASSAGE OF VEHICLES

[75] Inventor: Michael S. Birkin, Beeston, England

[73] Assignee: British Railways Board, London, England

[21] Appl. No.: 432,435

[22] Filed: Oct. 4, 1982

[30] Foreign Application Priority Data

Oct. 3, 1981 [GB] United Kingdom ..... 8129916

[51] Int. Cl.[3] ..... B61L 3/00; B61L 27/00; B61L 1/08

[52] U.S. Cl. ..... 246/187 B; 246/5; 246/63 R; 340/901; 340/907

[58] Field of Search ..... 340/901, 907; 246/187 B, 187 C, 180, 63 R, 134, 177, 178, 34 A, 4, 5, 34 R

[56] References Cited

U.S. PATENT DOCUMENTS

| | | | |
|---|---|---|---|
| 3,250,914 | 5/1966 | Reich | 246/5 |
| 3,787,679 | 1/1974 | Birkin | 246/178 |
| 4,026,506 | 5/1977 | Bourke | 246/63 R |
| 4,038,653 | 7/1977 | Brewster | 246/63 R |
| 4,046,342 | 9/1977 | Buzzard | 246/187 C |
| 4,093,161 | 6/1978 | Auer | 246/5 |

*Primary Examiner*—James J. Groody
*Attorney, Agent, or Firm*—Hayes, Davis & Soloway

[57] ABSTRACT

The control system is of the kind in which vehicle passage is controlled by a token, and is particularly suitable for single track railways.

According to the invention, such a system is electronic, and a central control and each vehicle in use in the system is provided with electronic transmitting and receiving equipment, by which an exclusive electronic token, or the like, is transmitted between the control and a designated vehicle, the arrangement being such that, only if the electronic token is issued to a vehicle, by simultaneous operation by the controller and vehicle operator, will that vehicle be authorized to proceed, said electronic token being withdrawn by the central control once the restricted section to which it relates has been traversed by said vehicle.

4 Claims, 9 Drawing Figures

CONTROL SYSTEM FOR CONTROLLING THE PASSAGE OF VEHICLES

This invention relates to control systems for controlling the passage of vehicles, which is particularly suitable for single track railways.

Since the commencement of the operation of railways in this country considerable ingenuity has been shown by signal engineers to develop relatively simple and reliable means to ensure safety of operation on lines that are capable of bi-directional working. These systems range from a simple "One Train Working" principle to a fully automatic signalling with track circuit control, such as described, for example, in the paper "Single Line Control by P. C. Doswell-Institution of Radio Signal Engineers, Booklet No. 4. The simplest system where a number of trains are required to be operated over a single track line is to use some form of staff, or token, the possession of which by the driver gives him absolute authority to proceed into the section to which the token relates. The major problem with such a token system is that it is cumbersome and can cause delay to the train, as a token is physically exchanged. Where a line is not a dead-end then a problem of token recovery can occur as one end of the line may collect more tokens than it sends.

An object of this invention is to provide a token system which is foolproof in operation and which avoids train delays.

According to this invention a control system of the kind referred to is characterised in that said system is electronic and includes a control centre having means for storing the identity of one, or a number of electronic tokens, each being unique to a particular restricted section, means for storing vehicle identities to which tokens are to be or have been issued, means for receiving the identity of each vehicle and checking its validity, means for encoding the electronic token to be transmitted to ensure the uniqueness of its reception by the relevant vehicle, means for controlling the system in a logical and proper sequence and controller interface means including a display, and input keyboard for token sending and receiving, said system also including a number of vehicles each having a unique electronically encoded identity, means for sending said unique identity, means for receiving an electronic token and checking its validity, means for displaying the identity of a received token to the vehicle operator, and means for withdrawing the said token, and said system further including transmission means for transmitting the said token and vehicle identity information between said control centre and said vehicles, the arrangement being such that an electronic token can only be issued or withdrawn when the controller and vehicle operator simultaneously operate their relevant token issuing and withdrawing means.

Figure 1:
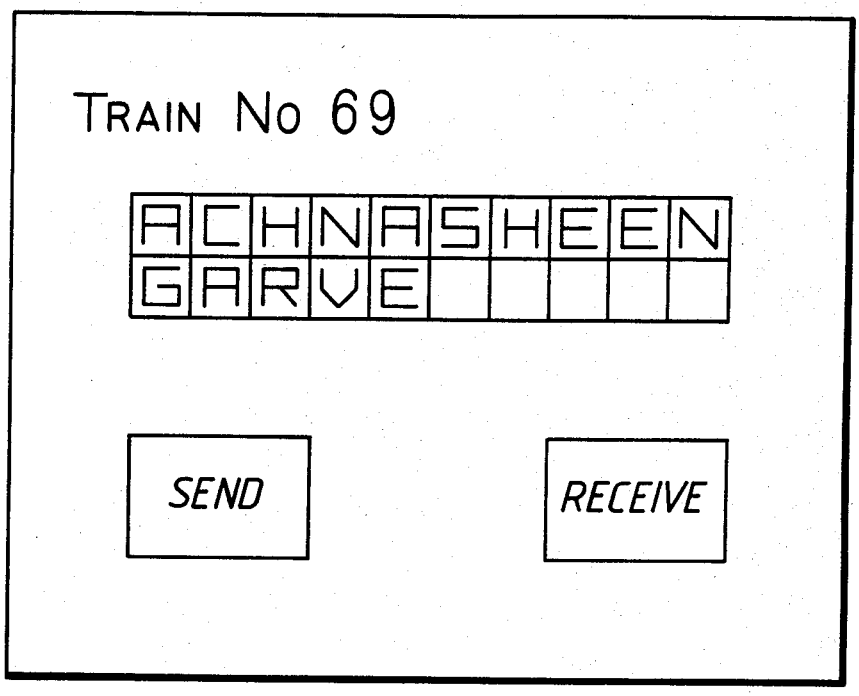
Figure 2:
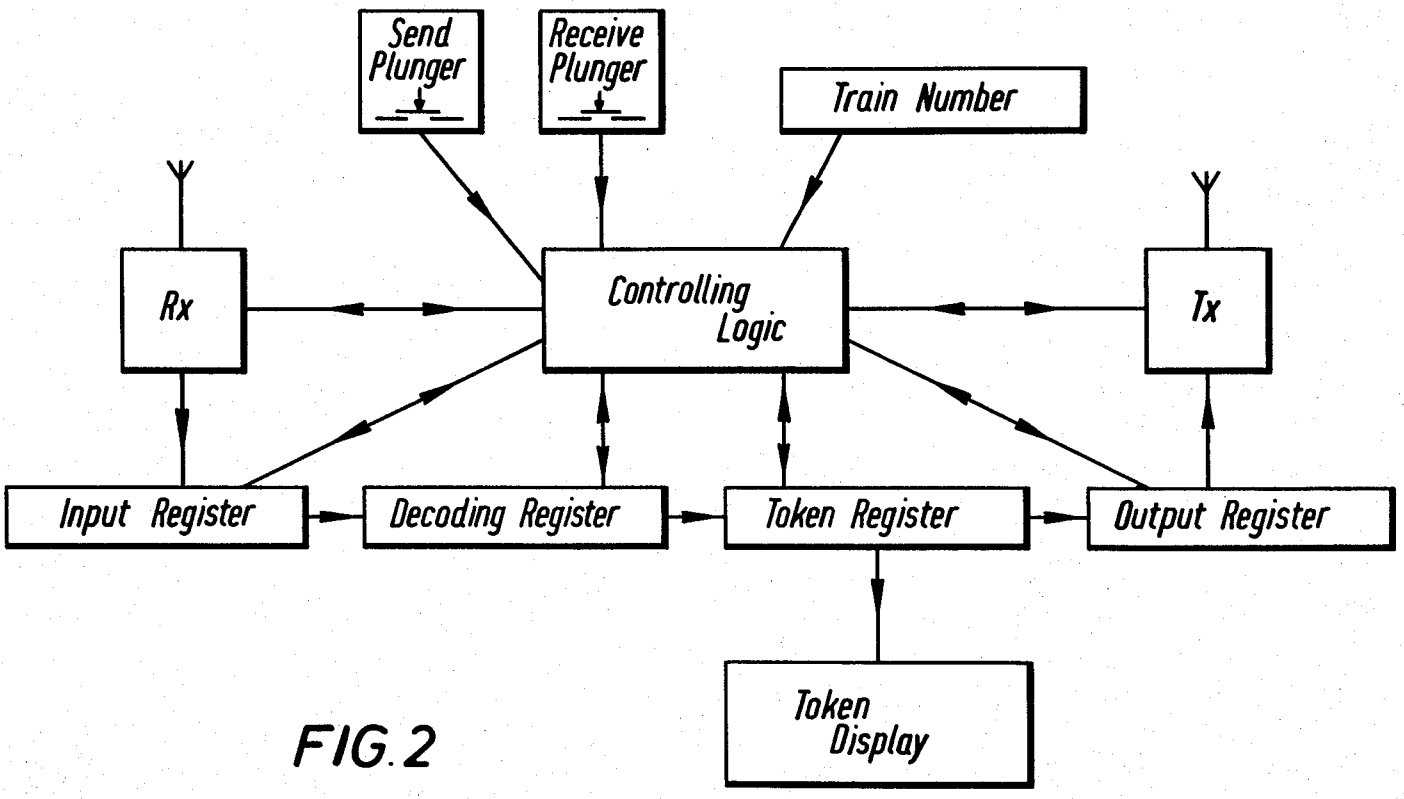
Figure 3:
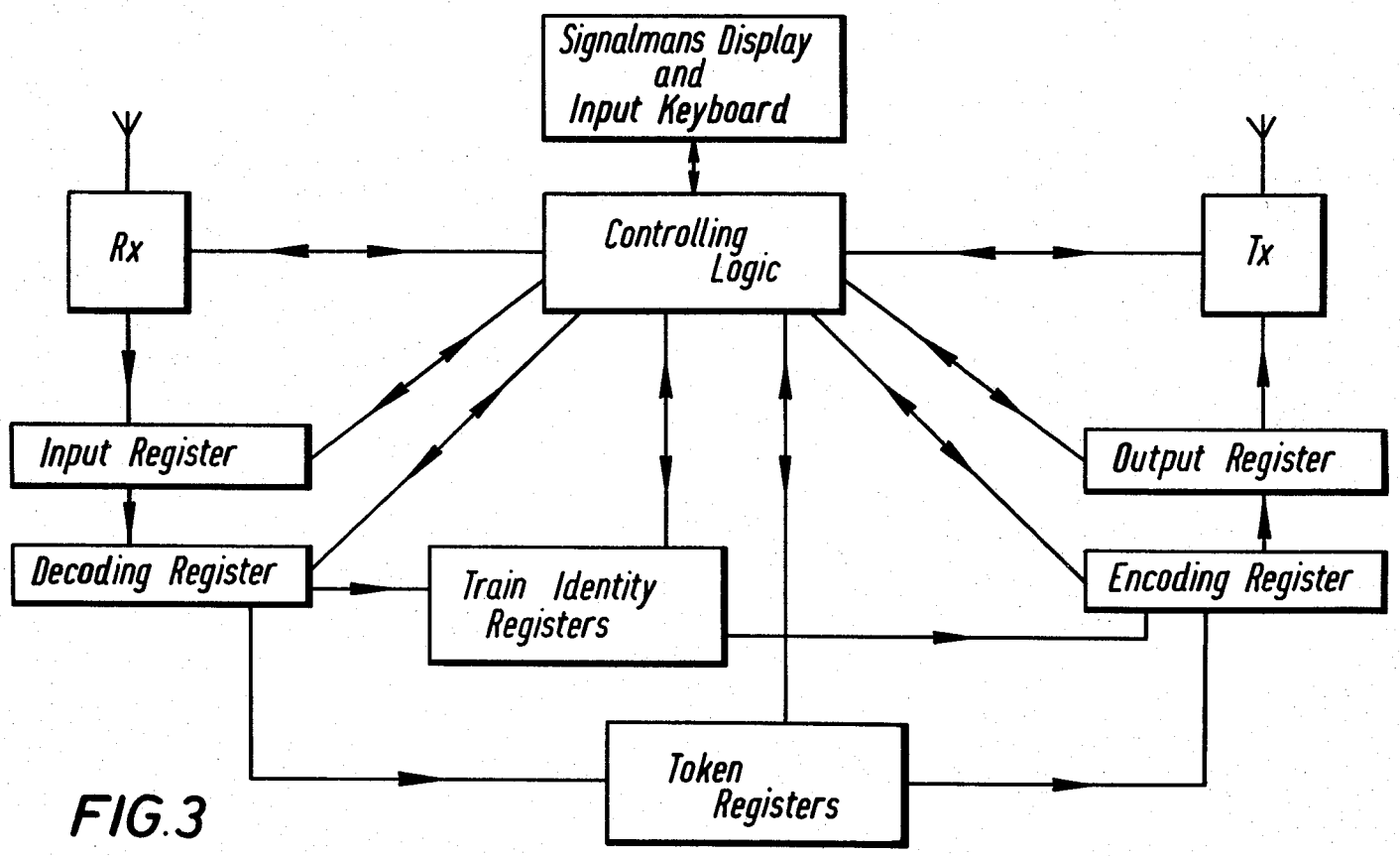
Figure 4A:
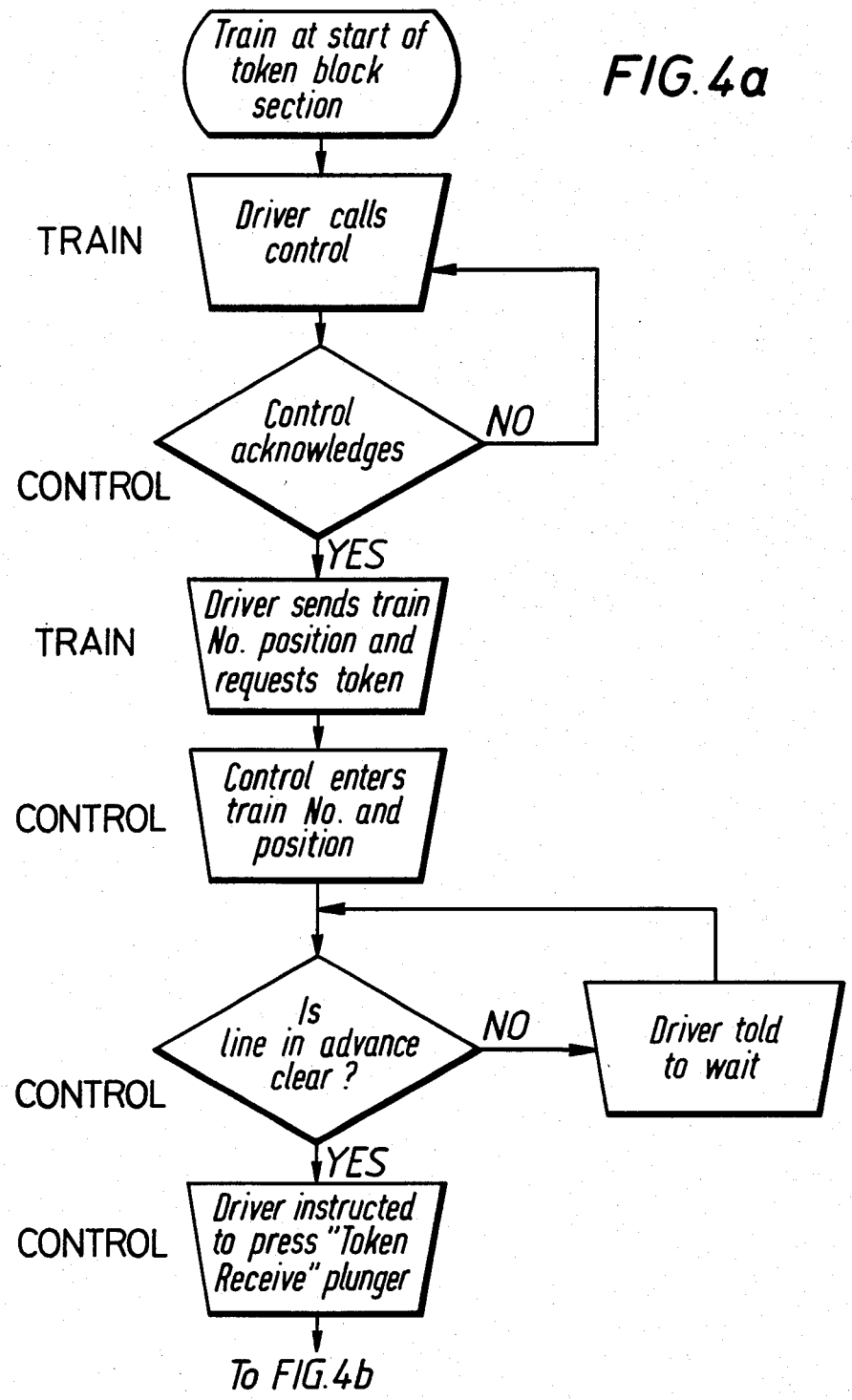
Figure 4B:
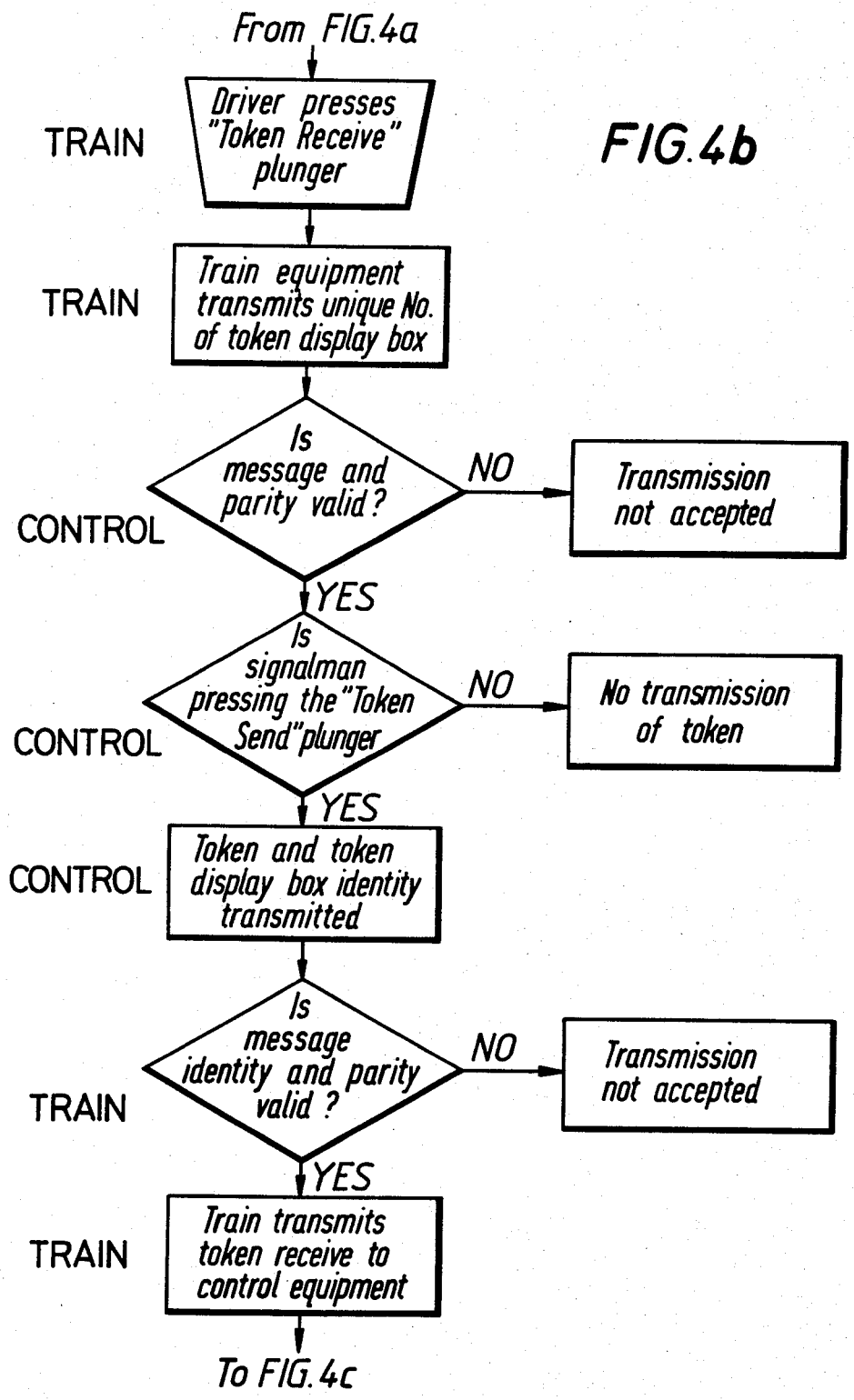
Figure 4C:
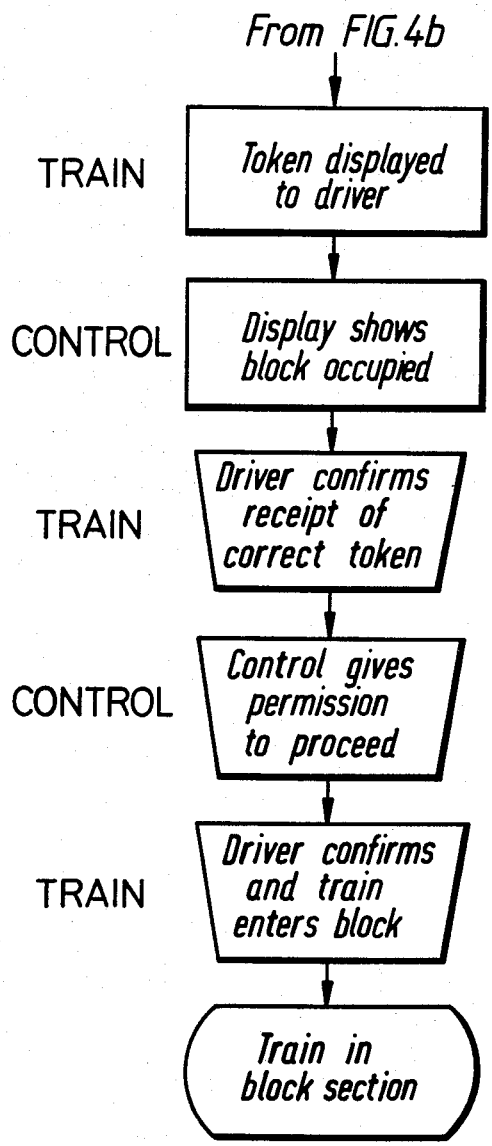
Figure 5A:
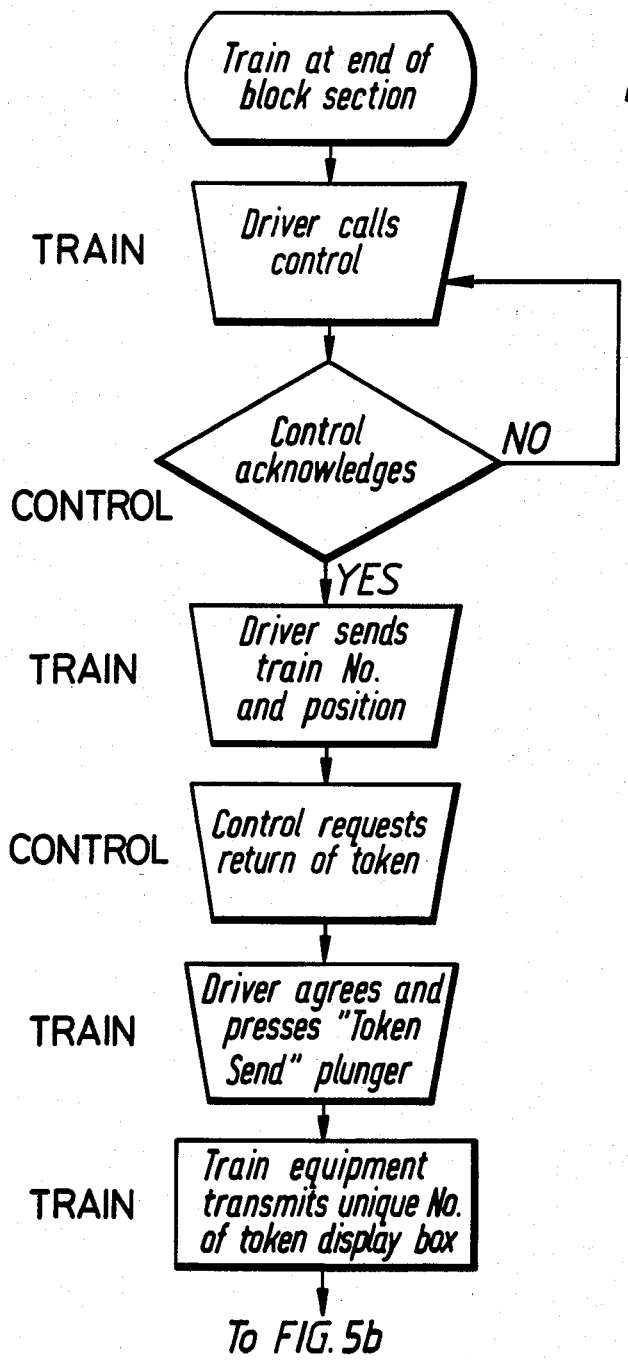
Figure 5B:
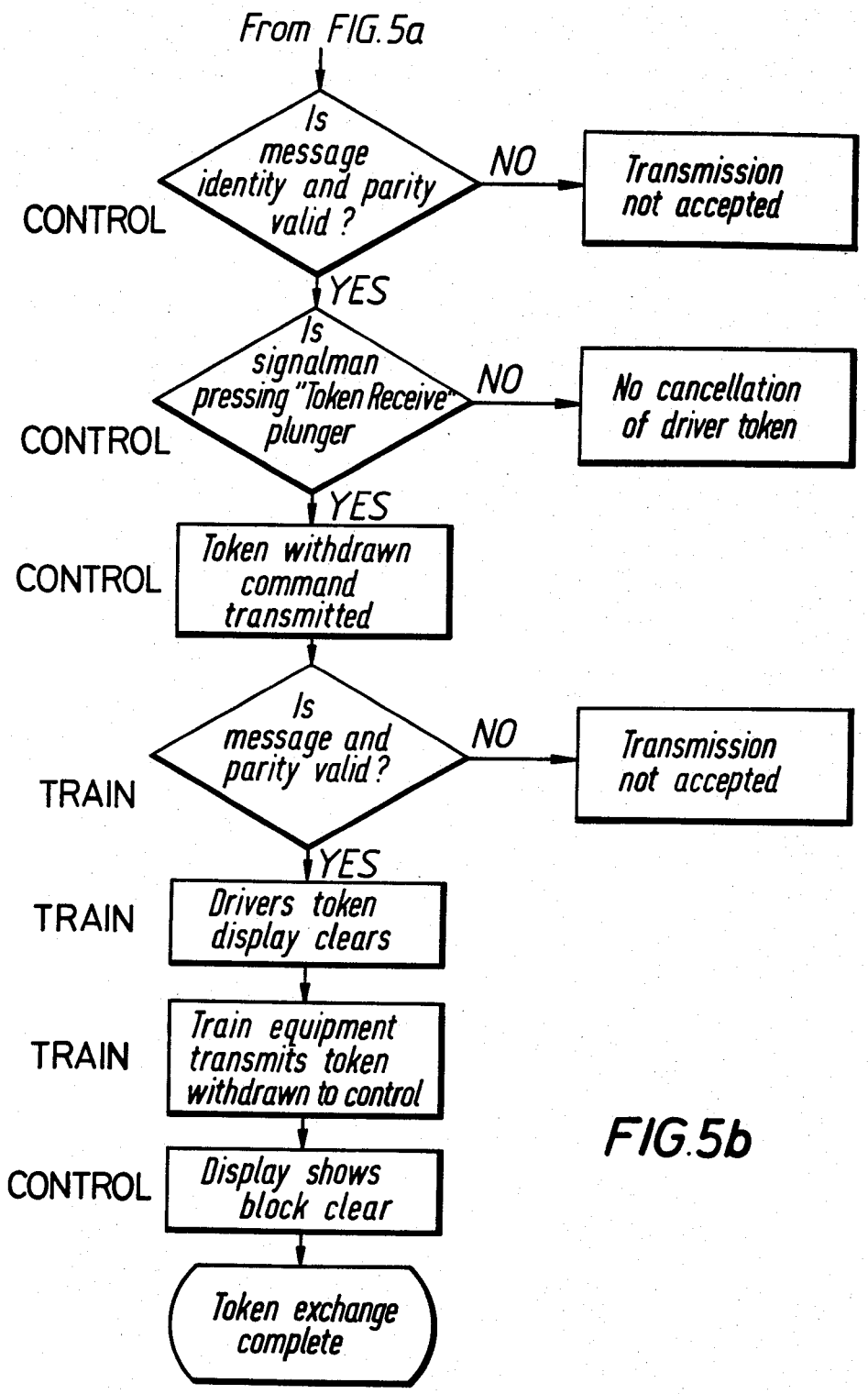
Figure 6:
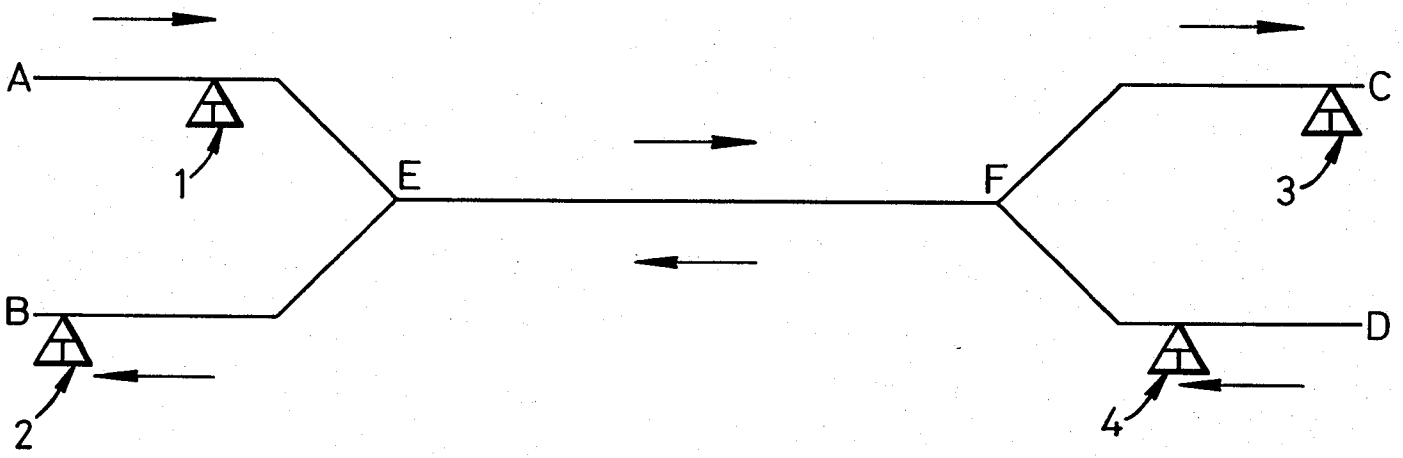

In order that the invention may be readily understood and further features made apparent, one control system in accordance therewith will now be described, by way of example, with reference to the accompanying drawings in which:

FIG. 1 is a diagrammatic representation of the driver display in one of the trains using the system, FIG. 2 is a simplified block diagram of the train equipment, FIG. 3 is a simplified block diagram of the control (signalman or dispatchers) equipment, FIGS. 4*a* to 4*c* provide a flowchart for transmission of the token to a train, FIGS. 5*a* to 5*b* provide a flowchart for transmission of the token to control, and FIG. 6 is a diagram showing how transponders may be placed in the track to facilitate automatic token transfer.

In this embodiment of the system, each train is fitted with radio telephone equipment capable of data transmission and reception. The data port on the radio equipment is connected to a token display box (see FIG. 1) having decoding logic (see FIG. 2), to check that the electronic token received by the train is valid and addressed to that particular train. All this equipment may be transportable. The control centre has in addition to its radio equipment a set of electronic registers capable of containing the electronic tokens and train numbers relevant to the area it controls (see FIG. 3).

The principle of operation is as follows:

When a train wishes to enter a single line block section the driver calls the central control via his radio telephone and verbally reports his train number and position; he then requests entry into the token controlled block. If the line is clear the control sends a verbal message addressed to the train stating that the token is available. The driver presses the "token receive" plunger, this transmits to the central control the unique number of the train's token display box and only if the signal man is also pressing this "token send" plunger, will the control centre encode the token identity of the relevant electronic token with this number as a key and transmit it back to the train. The train then decodes this message and, if valid, displays the token identity to the driver giving him route authority for the relevant block section in advance, after he has checked that the token is valid for that section. The display at the control will then indicate line occupied. Before he proceeds into the section, in advance, the driver will also receive verbal permission from Control.

When the train is at the end of this block section (for example, in the passing loop) the driver calls the central control via his radio telephone and verbally reports his train number and position. He then advises the control centre that he wishes to relinguish his token. The control sends a verbal message addressed with the train number to instruct the Driver to press his "send token" plunger. The driver presses this plunger and, only, if the signal man is pressing his "token receive" plunger, is the token withdrawn by the central control, and the driver's display indicates that the token has been so withdrawn. The display in the control centre then indicates line clear.

Detailed flow charts of token reception and transmission are shown in FIGS. 4*a* to 4*c* and 5*a* and 5*b* respectively, and when read in conjunction with the simplified block diagrams shown in FIGS. 2 and 3, provide a detailed appreciation of the system principles.

Thus, the system provides a display in each train cab which when valid, acts as a token and a constant reminder of authority to proceed, and which can only be held by one train. This is achieved by providing each train with a two-way radio with a unique identity and a means to transmit this identity to the control at the start of a journey, backed up by a verbal message to obtain a token. Thereafter the train identity is locked into the system until released at the far end, if a through route, or until cancelled by a dispatcher at control for some other reason. The type of driver's display to be preferred is one which gives the names of the ends of the single line section, as this will enable minor display faults to be ignored by the driver due to the normal redundancy of place names. A low security level of the information could also be tolerated reducing its cost. Thus, the control logic and the register in the train equipment may be implimented by the use of microprocessor techniques, or by means of discrete logic elements.

The control logic and the registers at the control centre may be implimented by either a triplicated microprocessor to ensure adequate safety and reliability, or by other means by which microprocessors may be used, by those skilled in the art, to ensure safe and reliable operation. A liquid crystal display with separate illumination, or a light emitting diode is suitable for the display at control.

Additionally, the exchange of tokens may be automated by the application of track mounted transponders. A means of showing how this may be achieved is shown in FIG. 6. In this embodiment, the vehicle records the transponder's identity, this is transmitted to the control by the vehicle communication means, and is used to initiate the appropriate token transfer. The principle of operation is as follows: A vehicle enters the system at point A when it reaches the transponder (1) it transmits the identity of that transponder to the control. If the line is clear the control responds with the appropriate electronic token for the single track section EF. When the vehicle leaves the single line section it traverses the transponder (3) which is placed in a suitable position to ensure that the vehicle, or vehicles comprising a train are clear of the point work of the single line section. On traversing this transponder (3) the vehicle reads the transponder and transmits its identity to the control. The receipt of this transponder's identity causes the control to withdraw the electronic token from the vehicle.

I claim:

1. A control system for controlling the passage of vehicles, of the kind in which the vehicles are authorized to pass through a restricted section by means of a unique token which is passed from a control point to a vehicle prior to entering said section and returned to a control point upon leaving said section, characterized in that said system is electronic and includes a control center having means for storing the identity of one, or a number of electronic tokens, each being unique to a particular restricted section, means for storing vehicle identities to which tokens are to be or have been issued, means for receiving the identity of each vehicle and checking its validity, means for encoding the electronic token to be transmitted to ensure the uniqueness of its reception by the relevant vehicle, means for controlling the system in a logical and proper sequence, interface means forming part of said control center, a display connected to said control center and the said interface means for displaying the status of the system to the controller, and an input keyboard also connected to said control center via said interface means for token sending and receiving by the controller, said system also including a number of vehicles each having a unique electronically encoded identity, means for sending said unique identity, means for receiving an electronic token and checking its validity, means for displaying the identity of a received token to the vehicle operator, and means for withdrawing the said token, and said system including transmission means for transmitting the said token and vehicle identity information between said control center and said vehicles, the arrangement being such that an electronic token can only be issued or withdrawn when the controller and vehicle operator simultaneously operate their relevant token issuing and withdrawing means.

2. A control system according to claim 1, characterized in that transponders or beacons, each having a unique identity, are located in the travel path of said vehicles for acting as trigger points for automatic exchange of said electronic token.

3. A control system according to claim 1, characterized in that the vehicle display gives names to the ends of said restricted sections so that minor display faults can be ignored and hence a low security level can be tolerated for transmission of information.

4. A control system according to claim 2, characterized in that the vehicle display gives names to the ends of said restricted sections so that minor display faults can be ignored and hence a low security level can be tolerated for transmission of information.

* * * * *